US005835068A

United States Patent [19]

Paul et al.

[11] Patent Number: 5,835,068

[45] Date of Patent: Nov. 10, 1998

[54] MICROWAVE TRANSCEIVER/ANTENNA SYSTEM WITH ADJUSTABLE MOUNTING AND ALIGNMENT MECHANISM

[75] Inventors: Jeffrey A. Paul, Torrance; Roy Wien, Cerritos; Douglas Klebe, Redondo Beach; Sergio Garcia, Hawthorne; Richard P. Mintzlaff, Granada Hills, all of Calif.

[73] Assignee: Raytheon Company, Lexington, Mass.

[21] Appl. No.: 707,276

[22] Filed: Sep. 3, 1996

[51] Int. Cl.[6] ..... H01Q 3/00

[52] U.S. Cl. ..... 343/757; 343/758; 343/882; 343/763

[58] Field of Search ..... 343/757, 758, 343/759, 761, 762, 763, 764, 765, 766, 878, 880, 881, 882, 702, 890, 891, 892; H01Q 3/00

[56] References Cited

U.S. PATENT DOCUMENTS 3,956,701 5/1976 James, Jr. et al. ..... 343/702

4,580,756 4/1986 Mori ..... 343/765

4,727,598 2/1988 Ehlers ..... 343/702

*Primary Examiner*—Hoanganh T. Le

*Attorney, Agent, or Firm*—Leonard A. Alkov; Glenn H. Lenzen, Jr.

[57] ABSTRACT

An integrated point-to-point microwave radio frequency unit/antenna system includes a microwave transceiver/antenna unit, a housing support element affixed to the microwave transceiver/antenna unit, and a mounting structure support element engaged to the housing support element. The mounting structure support element includes a fixedly adjustable ball-and-socket element, with either the ball or the socket affixed to the housing support element and the other affixed to an attachment structure. The mounting structure support element permits the microwave transceiver/antenna unit to be adjusted in three degrees of freedom.

10 Claims, 4 Drawing Sheets

MICROWAVE TRANSCEIVER/ANTENNA SYSTEM WITH ADJUSTABLE MOUNTING AND ALIGNMENT MECHANISM

BACKGROUND OF THE INVENTION

This invention relates to microwave radios, and, more particularly, to a radio frequency unit for a microwave radio.

Microwave radio communications are widely used to transfer large amounts of data, such as in earth and space microwave long-distance communications links. They are also of interest for shorter-range, lower-power applications such as the basic voice, video, and data links between, for example, a cellular base station and the central telephone office. In such applications, the microwave transmission distance is typically about ½–5 miles, the microwave signal may be a specific frequency in the range of about 2–94 GHz, and the power output of the microwave transmitter is about 100 milliwatts. Such microwave communications system are generally termed "point-to-point" systems.

Corresponding to the high-power microwave communications systems, a conventional point-to-point system has three basic physical parts: a signal processing unit (SPU), sometimes termed an "indoor" unit having the baseband radio components, a radio frequency (RF) unit (RFU), sometimes termed an "outdoor" unit having the microwave-frequency radio components, and an antenna. Because a microwave feed is required between the components operating at microwave frequency, the radio frequency unit is located within a few feet of the antenna, which ordinarily is mounted outside and aimed at another point-to-point terminal located some distance away. The antenna is typically a parabolic antenna of the cassegrain type. The signal processing unit may be located quite some distance from the radio frequency unit. An ordinary coaxial cable set extends between the signal processing unit and the radio frequency unit, but a microwave coaxial feed is required between the radio frequency unit and the antenna.

As point-to-point systems become more popular, their physical packaging becomes more important. The existing radio frequency units and antennas are bulky, heavy, and, in many cases, difficult to mount, align, and maintain in alignment. With the proliferation of point-to-point systems in large cities, new mounting space on existing masts and elsewhere has become more difficult to find. Installers must hoist the subsequently installed radio frequency unit and antenna to ever-more-precarious locations in order to establish line-of-sight contact with the remote terminal. The radio frequency unit and the antenna must be mounted in close proximity to each other. Conventional mounting systems for the radio frequency unit and the antenna include arrangements of brackets, guy wires, and turnbuckles. Great care must be taken in the alignment of the antenna with a remote antenna by adjustment of the mounting system. If the antenna must be replaced at a later time, the new antenna must again be aligned.

To overcome these problems, the assignee of the present invention is developing an integrated point-to-point microwave radio frequency unit and antenna, which is much more compact and lighter in weight than conventional systems. However, the problem remains of mounting the integrated unit in a manner so as to make alignment simple and convenient. Thus, there is a need for a mounting approach to be used in conjunction with the improved integrated radio frequency unit and antenna, which overcomes this problem. The present invention fulfills this need, and further provides related advantages.

SUMMARY OF THE INVENTION

The present invention provides an integrated point-to-point microwave radio frequency unit/antenna with a convenient mounting structure. The mounting structure permits the integrated radio frequency unit/antenna to be quickly and easily mounted to a structure such as a mast by a single person. Alignment is readily performed, with adjustment possible in three degrees of freedom—two angular for aiming purposes and one rotational to achieve a desired polarization. The support structure holds the integrated radio frequency unit/antenna in a stable fixed orientation after alignment is complete. If at a subsequent time the integrated radio frequency unit/antenna must be replaced, it is easily demounted and replaced by a single person. The mounting structure ensures that the replacement will be aimed at the same remote terminal as the removed unit, an important convenience because the difficultly and cost of re-alignment can be high. The mounting structure is light weight and inexpensive.

In accordance with the invention, an integrated point-to-point microwave radio frequency unit/antenna system comprises a microwave transceiver/antenna unit, a housing support element affixed to the microwave transceiver/antenna unit, and a mounting structure support element engaged to the housing support element. The mounting structure support element comprises a fixedly adjustable ball-and-socket element, with a first one of the ball and the socket being affixed to the housing support element and the other desirably affixed to an attachment structure such as a clamp. "Fixedly adjustable" means that the element may be adjusted and then fixed into place after adjustment.

The microwave transceiver/antenna unit preferably comprises a housing having a front face and a back face, and a microwave radio frequency transceiver electronics package within the housing, with the electronics package having an external connection and an antenna connection. There is preferably an antenna affixed to the front face of the housing; and a microwave radio frequency feed communicating between the antenna and the antenna connection of the microwave transceiver electronics package. In this approach, the housing support element is affixed to the back face of the housing.

The mounting element support structure preferably comprises a base comprising a base body, a base female spherical socket surface in the base body, a base bore extending through the base body and the spherical socket surface, at least two adjustment screw mounts supported on the base body, and an adjustment screw threadably engaged to each of the screw mounts. There is a ball component comprising a ball male spherical socket having an outer surface sized to be received within the base female spherical socket surface, a ball female spherical socket surface concentric with and of smaller radius than the ball male spherical socket, an annular flange extending around a base of the ball component and positioned so as to be engagable by the adjustment screws, an aperture extending through an apex region of the male spherical socket surface remote from the base of the ball component, and a mounting element engagable to the housing support element. A spherical locking nut comprises a male spherical locking nut surface sized to be received within the female spherical socket surface, and a locking nut bore extending therethrough in alignment with the base bore. A locking bolt extends through the locking nut bore and the base bore and has a locking bolt nut threadably engaged thereon.

The ball-and-socket mounting structure with its adjustment screws allows the microwave transceiver/antenna unit to be angularly aligned in the elevational and azimuthal directions by a coordinated movement of the adjustment screws. The aperture in the ball component permits the angular orientation to be varied according to the size of the aperture, and a total of 20 degrees of angular variation has been found to be satisfactory. By loosening all of the adjustment screws slightly, the entire microwave transceiver/antenna unit may be rotated about the direction pointing toward the remote unit, so that the polarization of the transmitted and received signals may be optimized. After angular and rotational alignments are complete, the locking bolt is tightened to hold the microwave transceiver/antenna unit in the selected fixed alignment. The adjustment screws may be loosened so as not to distort the microwave transceiver/antenna unit, for example due to temperature changes, or even removed.

The present invention, used in conjunction with a convenient housing support element such as a dovetail support, permits the microwave transceiver/antenna unit to be reproducibly and accurately aligned. If the microwave transceiver/antenna unit requires replacement, it may be readily removed and replaced, usually without the need for re-alignment. The entire system is much lighter and less bulky than prior conventional point-to-point units.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
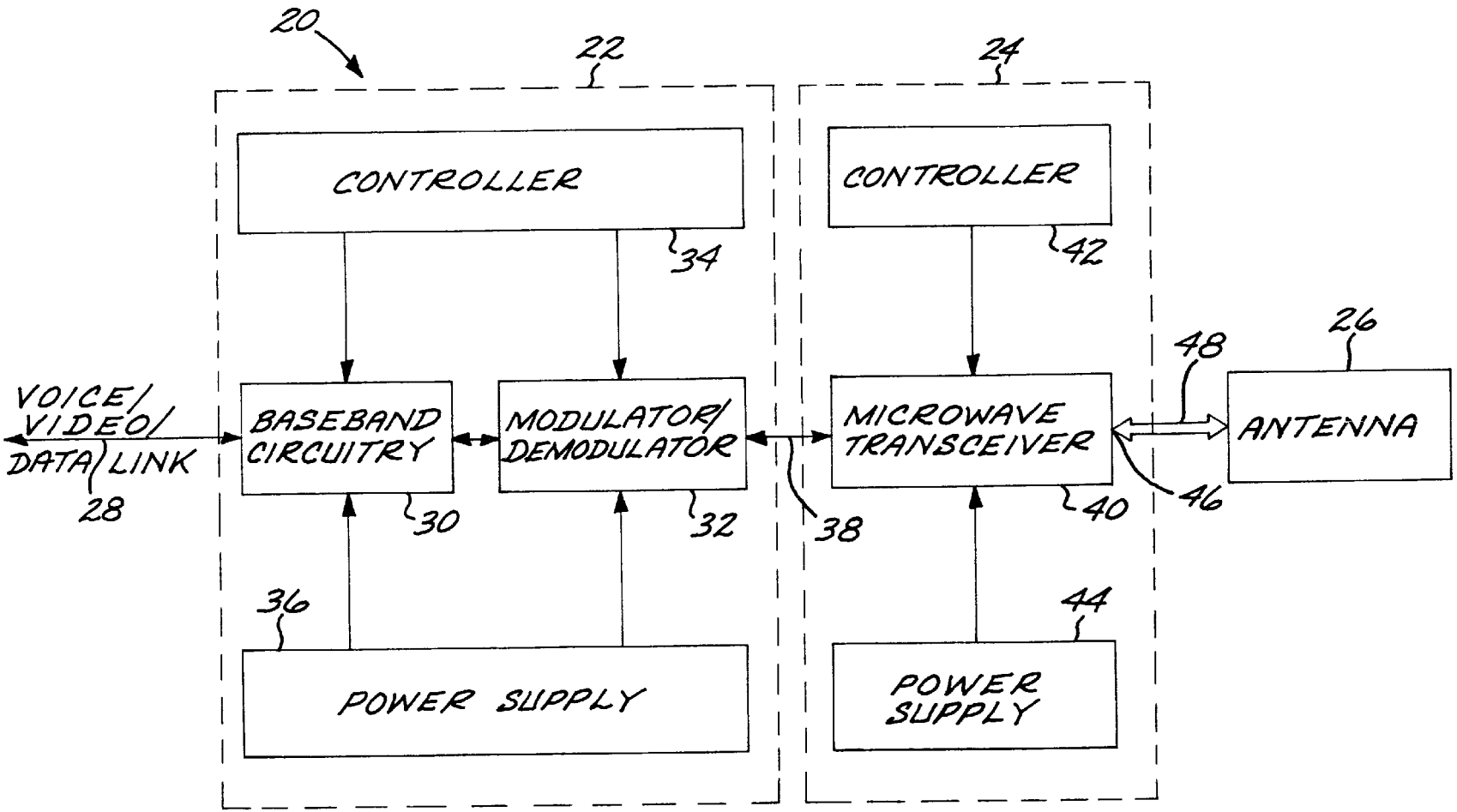
FIG. 1 is a schematic diagram of a microwave radio transmitter and receiver.

FIG. 1 is a schematic diagram of the electronics of a microwave radio transceiver system 20. The general electronic structure of such systems 20 is known in the art and is described in greater detail, for example, in "RF Components for PCS Base Stations", published by Strategies Unlimited, 1996. The present invention resides not in a change to this basic, known electronic approach, but in its packaging and mounting in a highly advantageous form.

The system 20 includes a signal processing unit 22 that processes baseband signals, a radio frequency unit 24 that processes microwave signals, and a microwave antenna 26. The signal processing unit has an input/output 28 of voice, video, and/or data link information. This input/output 28 is processed through baseband circuitry 30 and a modulator/demodulator 32. A controller 34 and a power supply 36 are also provided in the signal processing unit 22. The signal processing unit 22 communicates with the radio frequency unit 24 at low frequencies through a conventional coaxial signal cable 38.

The radio frequency unit 24 includes a microwave transceiver 40 that operates in a selected microwave frequency band within the broad band extending from about 2 to about 94 GHz (Gigahertz) by converting the low-frequency signal of the signal processing unit 22. A controller 42 and a power supply 44 are provided in the radio frequency unit 24. The microwave transceiver 40 has an antenna connection 46 into which a microwave radio frequency feed 48 is connected to provide a signal to the antenna 26, or to receive a signal from the antenna. The microwave radio frequency feed 48 may be a coaxial cable or waveguide which cannot be more than a few feet long without suffering substantial signal attenuation.

Figure 2:
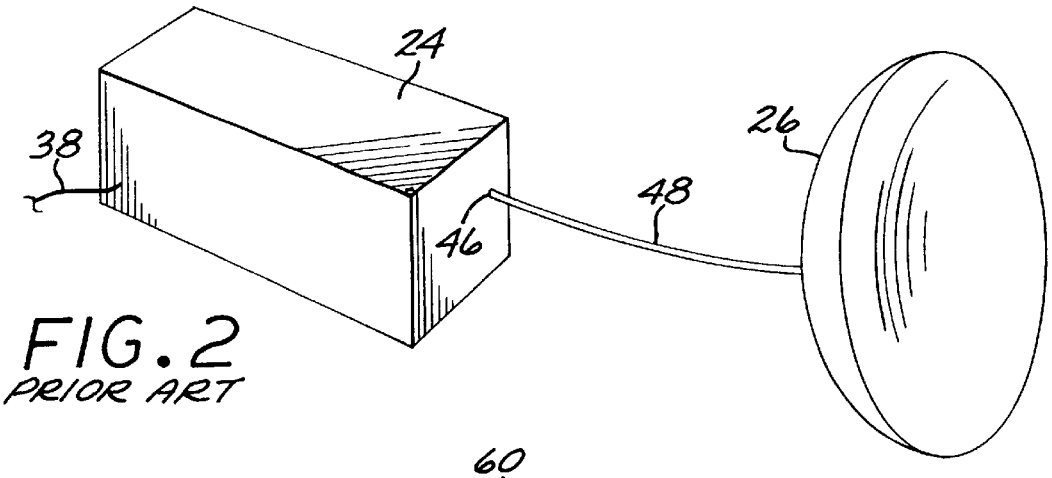
FIG. 2 PRIOR ART
FIG. 2 is a perspective view of a conventional microwave radio frequency unit and antenna.

FIG. 2 depicts the implementation of a conventional prior radio frequency unit 24 and antenna 26, connected by the microwave feed 48, which utilizes the electronics approach of FIG. 1. The radio frequency unit 24 typically has measurements of 12 inches by 12 inches by 12 inches and weighs about 35 pounds. The antenna 26 is a cassegrain parabolic antenna having a dish diameter of about 12 inches or more and a weight of about 15 pounds. Both components must be mounted at a location such that the antenna 26 may be aimed at a similar but remotely located terminal. The installer must find a way to mount the antenna 26 so that it is aligned with the antenna of the remote unit, and to mount the radio frequency unit 24 so that it is secure yet is within the range permitted by the length of the microwave feed 48. Other versions of the prior approach of FIG. 2 are known wherein the parabolic antenna is affixed directly to the radio frequency unit, but such a combined approach remains awkward to handle and heavy.

Figure 3A:
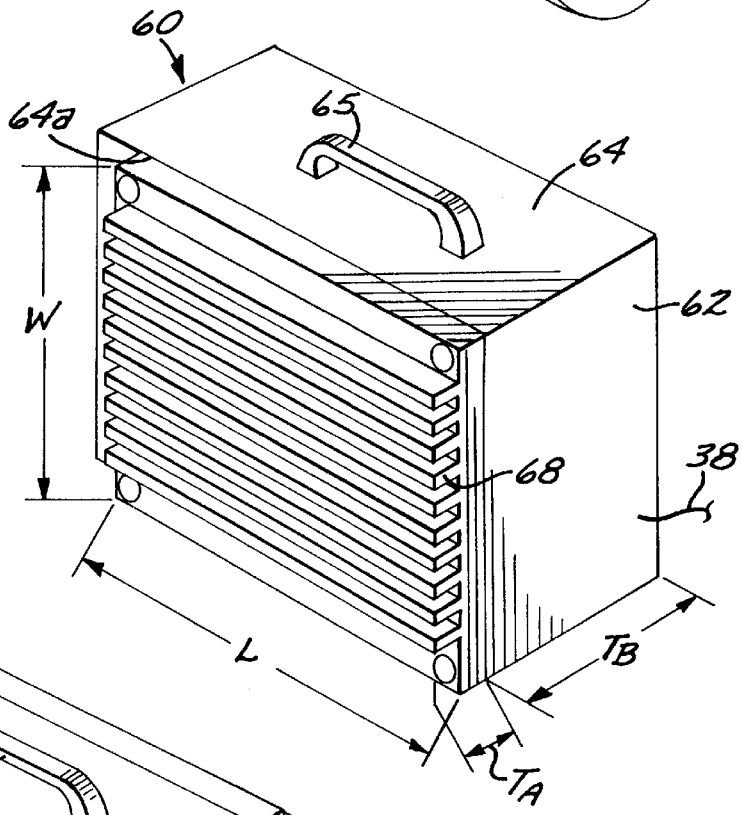
FIG. 3A is a front perspective view of an integrated radio frequency unit/antenna according to the invention.
Figure 3B:
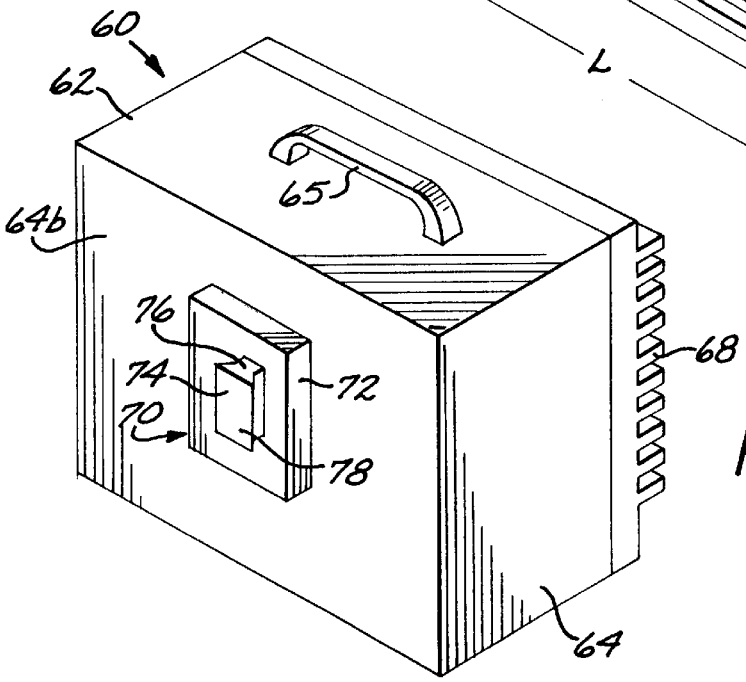
FIG. 3B is a back perspective view of the integrated radio frequency unit/antenna of FIG. 3A.

FIGS. 3A and 3B show an integrated radio frequency unit/antenna in front and back perspective views. This apparatus uses the general electronics approach of FIG. 1, but with a different architecture and antenna that offers important advantages. An integrated radio frequency unit/antenna 60 includes a housing 62 having an exterior wall 64 with a front face 64*a* and a back face 64*b*. A handle 65, which may be integral or detachable, extends from the housing 62 and permits the radio frequency unit/antenna 60 to be easily carried. A microwave radio frequency transceiver electronics package (not visible) is fixed in the housing 62. The electronics package includes the microwave transceiver 40, the controller 42, and the power supply 44. Part of the exterior wall 64, in this case the front face 64*a*, includes an integral flat antenna 68. The flat antenna 68 may be formed separately and attached to the wall 64, as illustrated, or it may be formed integrally as part of the wall itself. That portion of the wall 64 which is not the antenna 68 may be made of any operable material, such as a metal or a plastic. A radome (not shown) in the form of a plastic sheet may be mounted over the face of the flat antenna 68 to protect it. The flat antenna 68 is preferably a continuous transverse stub (CTS) antenna. The CTS microwave antenna is known in the art for other applications and is described, for example, in U.S. Pat. No. 5,266,961, whose disclosure is incorporated by reference.

The integrated radio frequency unit/antenna 60 has an antenna connection and a microwave radio frequency feed cable extending from the antenna connection to the back side of the flat antenna 68. However, that radio frequency feed is at most 1–2 inches long and contained entirely within the housing 62, and accordingly is not visible in FIGS. 3A and 3B. There is very little microwave attenuation as the signal passes through this short feed. The installer is only required to position and fix in place the single integrated radio frequency unit/antenna 60, and is not concerned with moving and positioning two units in a compatible manner.

FIG. 3B illustrates a portion of a support element 70 by which the housing 64 and attached components may be mounted to a mounting structure. The support element 70 includes a raised portion of the housing 64 in the form of a hat section 72 that extends rearwardly from the back face 64*b*. Fixed to the hat section 72 and extending further rearwardly therefrom is a first portion of the support element 70, a housing support element illustrated as a preferred male dovetail fitting 74. The male dovetail fitting 74 includes a relatively narrow base 76 and a laterally enlarged tenon 78.

Figure 4:
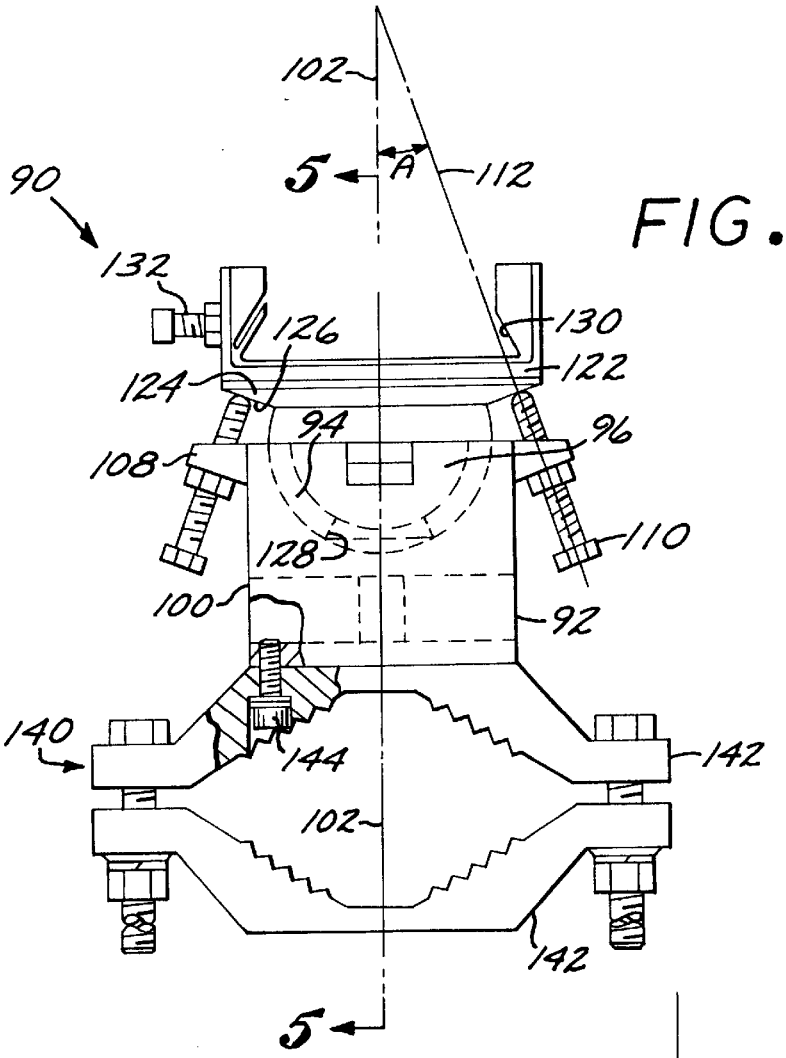
FIG. 4 is an elevational view of a mounting element support structure.
Figure 5:
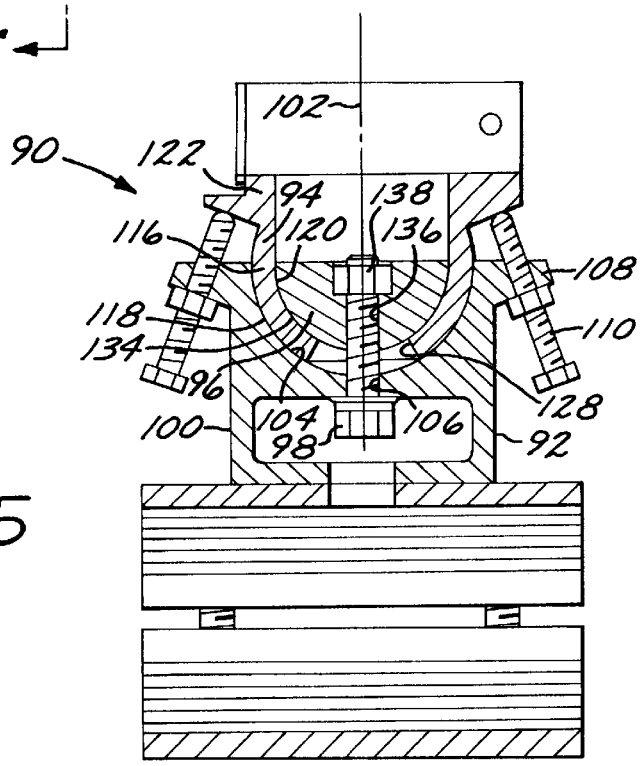
FIG. 5 is a section view of the mounting element support structure of FIG. 4, taken generally along line 5—5.

A mounting structure support element 90 is illustrated in FIGS. 4 and 5. This mounting structure support element 90 is a part of the support element 70. As will be discussed in greater detail subsequently, the function of the mounting structure support element 90 is to provide the attachment between the housing support element 70 and an external structure such as a mast.

The mounting structure support element 90 includes a base 92, a ball component 94 that engages to the base 90 in a ball-and-socket manner, a spherical locking nut 96 that holds the ball component 94 to the base 90 at a selected orientation, and a locking bolt 98 that, when tightened, locks the ball component 94 to the base 90, through the spherical locking nut 96. The ball component 94 engages to the housing support element, in the preferred case the male dovetail fitting 74, to support the radio frequency unit/antenna.

The base 92 includes a base body 100 having a mounting structure support element axis 102. A base female spherical socket surface 104 forms one surface of the base body 100, and is centered on the axis 102. A base bore 106 extends through the base body 100 coincident with the axis 102 and penetrates through the base female spherical socket surface 104. At least two adjustment screw mounts 108 extend outwardly in the form of ears from the sides of the base body 100. Preferably, there are four such adjustment screw mounts 108, spaced at 90-degree intervals around the perimeter of the base body 100. The adjustment screw mounts 108 include internal threads (not visible). An adjustment screw 110 is threadably engaged to the internal threads of each of the adjustment screw mounts 108. The adjustment screws preferably are rounded at the ends remote from the heads. The adjustment screw mounts 108 are preferably oriented so that an axis 112 of the adjustment screw 110 makes an angle A to the axis 102 of ½ the desired adjustment angle, which is preferably about ±20 degrees.

The ball component 94 includes a ball male spherical socket 116 having an outer surface 118 sized to be received within the base female spherical socket surface 104. The socket surfaces 116 and 104 are preferably hemispheres or a slightly lesser portion of a sphere, so that they can be easily engaged to or disengaged from each other. The male spherical socket 116 also includes a ball female spherical socket surface 120 that is concentric with and of smaller radius than the ball male spherical socket 116.

The ball component includes a base 122 to which the ball male spherical socket 116 is attached. An annular flange 124 extends around the periphery or circumference of the base 122. The annular flange 124 is positioned so that it may be engaged by the rounded tips of the adjustment screws 110. The annular flange 124 is preferable oriented with an inclination so that its surface 126 lies approximately perpendicular to the axis 112 of the adjustment screw 110. An aperture 128 extends through the ball male spherical socket 116 at its apex. The aperture 128 subtends an angle, preferably of about ±20 degrees from the axis 102 (40 degrees total), relative to the center of the ball male spherical socket 116, to allow angular adjustment up to that amount, as will be discussed subsequently.

A female dovetail mounting element 80 engagable to the male dovetail housing support element 74 is affixed to the base 122 of the ball component 94, facing away from the male spherical socket 116. In the preferred embodiment, the mounting element is a second part of a dovetail fitting, in this case a mortise 130. The mortise 130 is sized to receive the tenon 78 therein. A set screw 132 is provided to hold the tenon 78 in a selected location within the mortise 130.

The spherical locking nut 96 has a male spherical locking nut surface 134 sized to be received within the ball female spherical socket surface 120. A locking nut bore 136 extends through the spherical locking nut 96 in alignment with the base bore 106.

The locking bolt 98 extends through the base bore 106 and the locking nut bore 136. The locking bolt has a locking bolt nut 138 threadably engaged thereon. When the nut 138 is tightened, the spherical locking nut 96 is drawn against the ball male spherical socket 116 of the ball component 94, which in turn is drawn against the base female spherical socket surface 104 and the base 92. When the nut 138 is loosened, the spherical locking nut 96 is permitted to swivel in a ball-and-socket fashion relative to the base 92, to the extent permitted by the subtended angle of the aperture 128.

Figure 6:
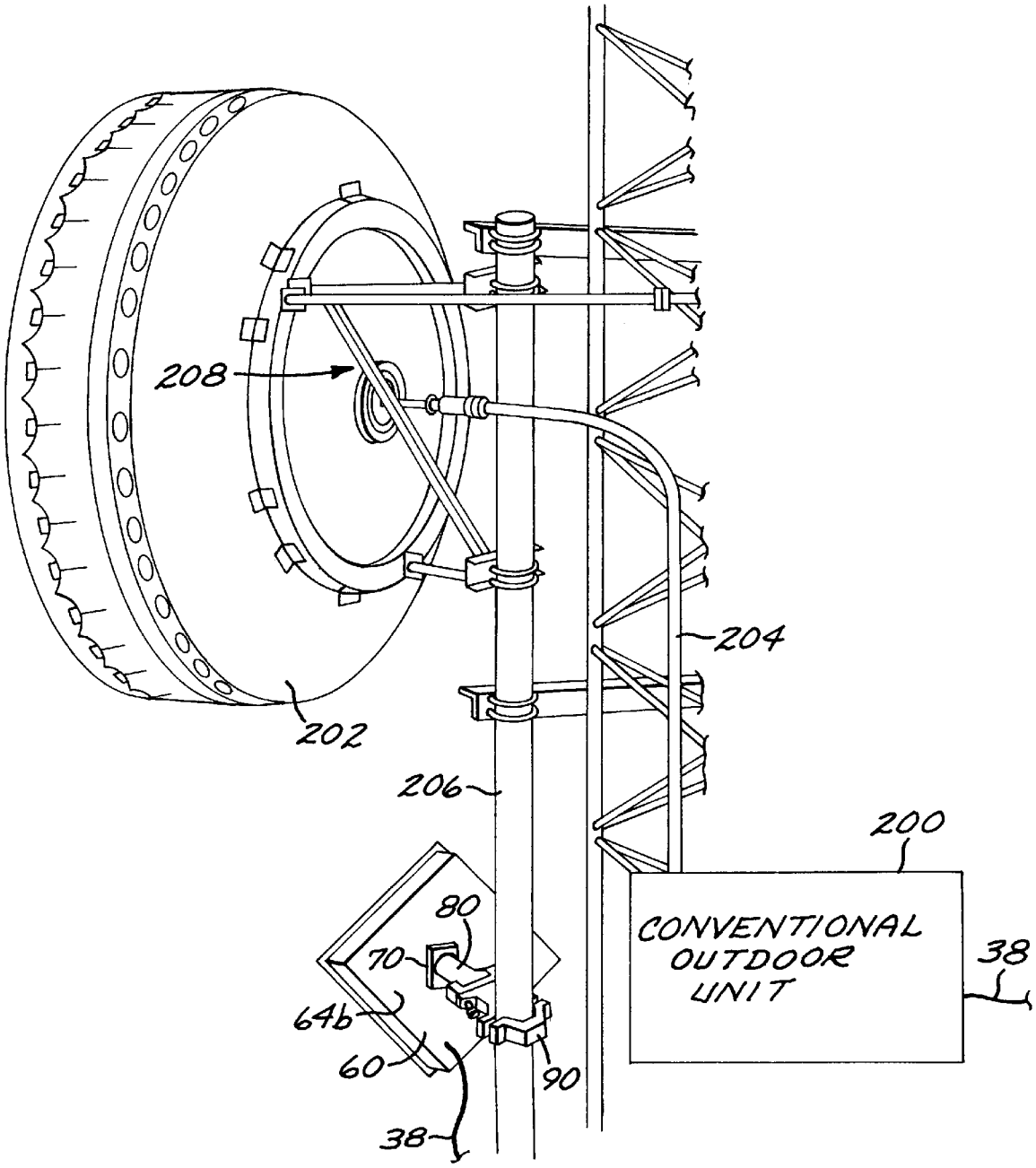
FIG. 6 is a schematic perspective view of a conventional radio frequency unit and antenna and an integrated radio frequency unit/antenna mounted to a mast.

An attachment structure 140 is affixed to the base 92. The attachment structure 140 is selected to be compatible with the structure to which the housing 62 of the system 20 is to be attached. In a typical case such as attachment to a vertical mast, the attachment structure 140 includes a pipe clamp 142 that is affixed to the base 92 with bolts 144. The pipe clamp 142 is sized to permit attachment to the vertical mast, as shown in FIG. 6. However, the specific attachment structure may be selected according to particular mounting requirements.

The mounting and alignment of the microwave radio frequency unit/antenna structure is preferably accomplished by affixing the attachment structure 140 to the external support structure. In the preferred illustrated case, the pipe clamp 142 is placed around a vertical mast, so that the axis 102 of the mounting structure support element 90 is roughly aimed at the remote location of another antenna. The microwave radio frequency unit/antenna 60 is installed to the mounting structure support element 90 using the dovetail tenon-and-mortise attachment. The installation technician monitors a signal received through the microwave radio frequency unit/antenna 60 from the remote location for appropriate signal parameters.

The locking bolt 98 is slightly loose at this point to allow movement of the ball-and-socket structure, but not so loose as to leave a gap between the parts of the mounting structure support element 90. The adjustment screws 110 are adjusted against the annular flange 124 so as to optimize the received signal parameter by changing the elevational and azimuthal angles of the microwave radio frequency unit/antenna 60, thereby aligning the microwave radio frequency unit/antenna. In a typical case, the signal parameter of interest is the signal amplitude, and the adjustment screws 110 are varied to change the alignment angles to maximize the signal amplitude. At the same time, the ball-and-socket arrangement permits the microwave radio frequency unit/antenna 60 to be rotated about the axis 102, so as to optimize the polarization angle relative to the remote unit. When the signal is optimized, the locking bolt nut 138 is tightened to hold the microwave radio frequency unit/antenna 60 in the desired orientation. The adjustment screws 110 may be left in contact with the annular flange 124. More preferably, however, the adjustment screws 110 are backed off from contact with the annular flange 124, so that they cannot exert any force against the flange that would adversely affect the alignment (such as experienced when the sun asymmetrically heats the mounting structure support element).

The use of the ball-and-socket approach to a mounting structure is made possible by the light weight of the microwave radio frequency unit/antenna and its integration into a single package. Mounting and alignment are accomplished easily by a single person. The ball-and-socket approach provides three degrees of freedom in alignment: the elevational and azimuthal angles and the rotation about the axis to optimize polarization. The use of the dovetail structure permits the microwave radio frequency unit/antenna to be readily removed and replaced, when necessary, without realignment.

FIG. 6, which is schematic and not drawn to scale, illustrates the mounting of a conventional radio frequency unit 200 and its antenna 202, connected by their microwave feed 204, on a mast 206, as well as an integrated radio frequency unit/antenna and its mounting structure according to the present approach. The antenna 202 is affixed to the mast 206 by a combination of brackets, struts, and guy wires (collectively, the support 208) whose positions may be adjusted by turnbuckles, adjustment screws, or the like. This support approach does not permit easy locking of the antenna to the mast and straightforward alignment, as with the present approach, does not permit easy elevational and azimuthal adjustment, and does not permit easy rotational adjustment for polarization alignment. Moreover, if the antenna must be changed for any reason, the support structure must be disassembled to such a degree that complete realignment is usually necessary.

By contrast, the integrated radio frequency unit/antenna 60 is mounted to the mast 206 by the mounting structure support element 90. The mounting structure support element 90 has the structure shown in FIGS. 4–5, allowing alignment to be readily accomplished in the elevational and azimuthal directions, as well as polarization adjustment about the alignment direction.

The support approach of the invention has been reduced to practice with a prototype integrated radio frequency unit/antenna 60 for operation at a microwave frequency of 37–40 GHz, as shown in FIG. 3A. The flat antenna has a width W of about 10½ inches, a length L of about 10½ inches, and a thickness $T_A$ of about 1 inch. The remaining components, the microwave transceiver 40, controller 42, and power supply 44 fit into a housing having the same length and width, and a thickness $T_B$ of about 2 inches. The total size of the housing and antenna package is about 12 inches by 12 inches by 3 inches. The weight of the integrated radio frequency unit/antenna 60 is about 13 pounds. It is highly desirable that this weight be less than about 15 pounds, as substantially larger weights become much more difficult for personnel to carry to exposed mounting locations. The support approach described herein is fully satisfactory for mounting this device.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An integrated point-to-point microwave radio frequency unit/antenna system, comprising:

a microwave transceiver/antenna unit;

a housing support element affixed to the microwave receiver/antenna unit; and a mounting structure support element engaged to the housing support element, the mounting structure support element comprising a fixedly adjustable ball-and-socket element wherein said mounting structure support element comprises:

(a) a base comprising (i) a base body, (ii) a base female spherical socket surface in the base body, (iii) a base bore extending throughout the base body and the base female spherical socket surface, (iv) at least two adjustment screw mounts supported on the base body, (v) an adjustment screw threadably engaged in screw mounts, (b) a ball component comprising (i) a ball male spherical socket having an outer surface sized to be received within the base female spherical socket surface, (ii) a ball female spherical socket surface concentric with and of smaller radius than the outer surface of the ball male spherical socket, (iii) an annular flange extending around a base of the ball component and positioned so as to be engagable by the adjustment screws, (iv) an aperture extending through an apex region of the male spherical socket remote from the base of the ball component, and (v) a mounting element engagable to the housing support element, and (c) a spherical locking nut comprising (i) a male spherical locking nut surface sized to be received within the ball female spherical socket surface, and (ii) a locking nut bore extending therethrough in alignment with the base bore, and (d) a locking bolt extending through the locking nut bore, the aperture, and the base bore, and having a locking bolt nut threadably engaged thereron.

2. The system of claim 1, wherein the microwave transceiver/antenna unit comprises:

a housing having a front face and a back face;

a microwave radio frequency transceiver electronics package within the housing, the electronics package having an external connection and an antenna connection;

an antenna affixed to the front face of the housing; and a microwave radio frequency feed communicating between the antenna and the antenna connection of the microwave transceiver electronics package, and wherein the housing support element is affixed to the back face of the housing.

3. The system of claim 1, further including:

an attachment structure affixed to a ball component of said ball-and-socket element.

4. The system of claim 3, wherein the attachment structure comprises a clamp.

5. An integrated point-to-point microwave radio frequency unit/antenna system, comprising:

a housing having a front face and a back face;

a microwave radio frequency transceiver electronics package within the housing, the electronics package having an external connection and an antenna connection;

an antenna affixed to the front face of the housing;

a microwave radio frequency feed communicating between the antenna and the antenna connection of the microwave transceiver electronics package;

a housing support element affixed to the housing; and a mounting structure support element engaged to the housing support element, the mounting structure support element comprising a base comprising a base body, a base female spherical socket surface in the base body, a base bore extending through the base body and the base female spherical socket surface, at least two adjustment screw mounts supported on the base body, and an adjustment screw threadably engaged to each of the screw mounts, a ball component comprising a ball male spherical socket having an outer surface sized to be received within the base female spherical socket surface, a ball female spherical socket surface concentric with and of smaller radius than the outer surface of the ball male spherical socket, an annular flange extending around a base of the ball component and positioned so as to be engagable by the adjustment screws, an aperture extending through an apex region of the ball male spherical socket remote from the base of the ball component, and a mounting element engagable to the housing support element, and a spherical locking nut comprising a male spherical locking nut surface sized to be received within the ball female spherical socket surface, and a locking nut bore extending therethrough in alignment with the base bore, and a locking bolt extending through the locking nut bore, the aperture, and the base bore, and having a locking bolt nut threadably engaged thereon.

6. The system of claim 5, further including an attachment structure affixed to the base.

7. The system of claim 6, wherein the attachment structure comprises a clamp.

8. The system of claim 5, wherein an axis of the adjustment screw is inclined to an axis of the locking bolt at an angle of about 20 degrees.

9. The system of claim 5, wherein there are four screw mounts positioned at 90 degrees from each other around a circumference of the base body.

10. The system of claim 5, wherein the housing support element is one of a mortise and a tenon.

* * * * *